US009227418B1

(12) United States Patent
Hsia et al.

(10) Patent No.: US 9,227,418 B1
(45) Date of Patent: Jan. 5, 2016

(54) INKJET CARTRIDGE WITH BARRIER LAYER

(71) Applicant: VIDEOJET TECHNOLOGIES INC., Wood Dale, IL (US)

(72) Inventors: Ta-Chung Hsia, Chesterfield, MO (US); Kevin Kuester, Freeburg, IL (US); John Wall, Fairview Heights, IL (US)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 14/769,746

(22) PCT Filed: Mar. 10, 2014

(86) PCT No.: PCT/US2014/022425
§ 371 (c)(1),
(2) Date: Aug. 21, 2015

(87) PCT Pub. No.: WO2014/159184
PCT Pub. Date: Oct. 2, 2014

Related U.S. Application Data

(60) Provisional application No. 61/779,667, filed on Mar. 13, 2013.

(51) Int. Cl.
*B41J 2/175* (2006.01)

(52) U.S. Cl.
CPC ..... *B41J 2/17553* (2013.01)

(58) Field of Classification Search
CPC ..... B41J 2/17553
USPC ..... 347/86
See application file for complete search history.

(56) References Cited

U.S. PATENT DOCUMENTS

| | | | | |
|---|---|---|---|---|
| 5,444,473 | A * | 8/1995 | Hattori | B41J 2/17553 347/87 |
| 5,517,221 | A * | 5/1996 | Nguyen | B41J 2/16508 347/28 |
| 5,852,459 | A | 12/1998 | Pawlowski | |
| 6,033,610 | A | 3/2000 | Swanson | |
| 6,845,800 | B2 | 1/2005 | Dods | |
| 6,863,387 | B2 | 3/2005 | Thielman | |
| 8,091,993 | B2 | 1/2012 | Gilson | |
| 8,109,614 | B2 | 2/2012 | Giovanola | |
| 2004/0189756 | A1 | 9/2004 | Ikezaki | |

FOREIGN PATENT DOCUMENTS

| | | |
|---|---|---|
| EP | 0832748 | 4/1998 |
| EP | 0965451 | 12/1999 |
| EP | 1053876 | 11/2000 |

(Continued)

*Primary Examiner* — Justin Seo
*Assistant Examiner* — Michael Konczal
(74) *Attorney, Agent, or Firm* — Joseph A. Yosick

(57) ABSTRACT

A thermal inkjet cartridge for an organic solvent-based ink includes a cartridge housing, a printhead attached to the housing, and a collapsible ink reservoir disposed in the housing. The ink reservoir has an opening through which ink is supplied to the printhead in fluid communication with the ink reservoir. The reservoir includes a basin member defining a first major portion of the ink reservoir and a movable plate defining a second major portion of the ink reservoir. At least one of the basin member and the movable plate includes a barrier layer for reducing the migration of solvent from the ink reservoir to an external environment.

19 Claims, 6 Drawing Sheets

(56) References Cited

FOREIGN PATENT DOCUMENTS

| | | | | | |
|---|---|---|---|---|---|
| EP | 1510346 | 3/2005 | | | |
| EP | 0604235 | 6/2010 | | | |
| EP | 2261036 | 12/2010 | | | |
| WO | 2009143422 | 11/2009 | | | |
| WO | WO 2009143422 | A2 * | 11/2009 | ..... | B41J 2/17513 |

* cited by examiner

INKJET CARTRIDGE WITH BARRIER LAYER

BACKGROUND

The present disclosure relates to inkjet printers and inkjet cartridges. More specifically, the present disclosure relates to an ink reservoir for an inkjet cartridge with a barrier layer for reducing solvent loss.

Typically, an inkjet cartridge includes an outer housing within which an ink containment system or ink reservoir is disposed in fluid communication with an inkjet printhead. A mechanism linked to the ink reservoir generates a negative pressure or backpressure that is maintained within a sufficient range to prevent ink from leaking from the printhead, but also allow ejection of ink for printing. Prior inkjet cartridges used primarily water-based inks, for which solvent loss is not usually an issue. However, cartridges containing inks with volatile organic solvents may lose significant amount of the organic solvent by migration of the solvent through the cartridge materials to the ambient environment.

BRIEF DESCRIPTION OF THE INVENTION

The present disclosure provides a thermal inkjet cartridge for use with organic solvent based ink compositions. In particular, it provides a cartridge with an ink reservoir that includes a barrier layer for decreasing the loss of volatile organic solvent from the cartridge.

In one embodiment, a thermal inkjet cartridge for an organic solvent-based ink includes a cartridge housing, a printhead attached to the housing, and a collapsible ink reservoir disposed in the housing. The ink reservoir has an opening through which ink is supplied to the printhead in fluid communication with the ink reservoir. The reservoir includes a basin member defining a first major portion of the ink reservoir and a movable plate defining a second major portion of the ink reservoir. At least one of the basin member and the movable plate includes a barrier layer for reducing the migration of solvent from the ink reservoir to an external environment.

In another embodiment, a thermal inkjet cartridge for an organic solvent-based ink includes a cartridge housing, a printhead attached to the housing, and a collapsible ink reservoir disposed in the housing. The ink reservoir has an opening through which ink is supplied to the printhead in fluid communication with the ink reservoir. The reservoir includes a first rigid member defining a first major portion of the ink reservoir and a second rigid member defining a second major portion of the ink reservoir. At least one of the first member and the second member includes a metal barrier layer for reducing the migration of solvent from the ink reservoir to an external environment.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE INVENTION

Figure 1:
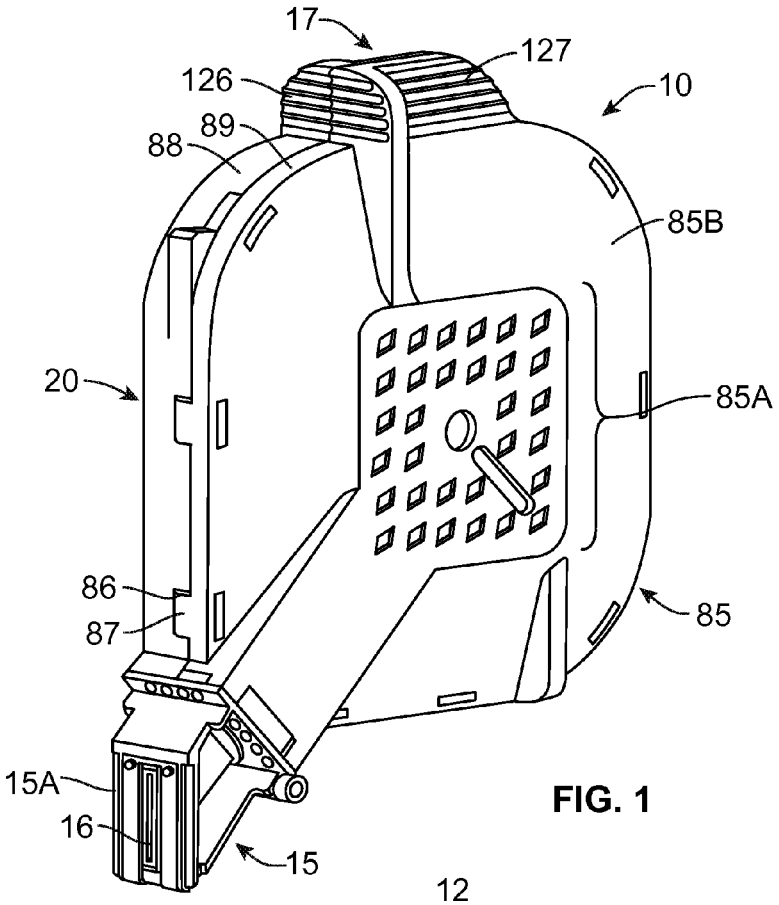
FIG. 1 is a top perspective view of an embodiment of an inkjet cartridge.

Reference will now be made in detail to the embodiments consistent with the invention, examples of which are illustrated in the accompanying drawings. Wherever possible, the same reference numerals are used throughout the drawings and refer to the same or like parts.

The present disclosure provides a thermal inkjet cartridge for use with organic solvent based ink compositions. In particular, it provides a cartridge with an ink reservoir that includes one or more barrier layers for decreasing the loss of volatile organic solvent from the cartridge. It is desirable to minimize the loss of solvent from the cartridge for several reasons. The loss of solvent increases the solid content of the ink and decreases the printer performance, as well as losing the amount of ink available to print from the cartridge. Thus, excessive solvent loss will cause the cartridge to run out of ink quicker than expected.

Figure 2A:
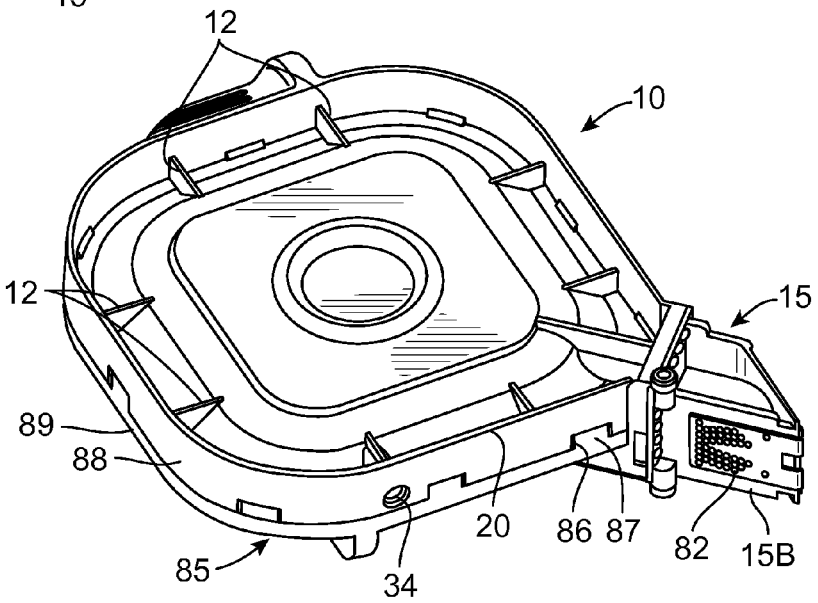
FIG. 2A is a bottom perspective view of the inkjet cartridge shown in FIG. 1.
Figure 2B:
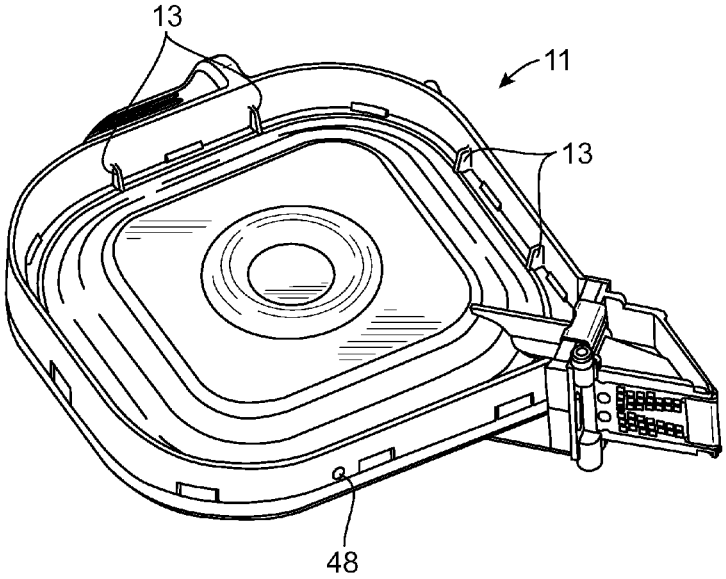
FIG. 2B is a bottom perspective view of another embodiment of an inkjet cartridge.
Figure 3:
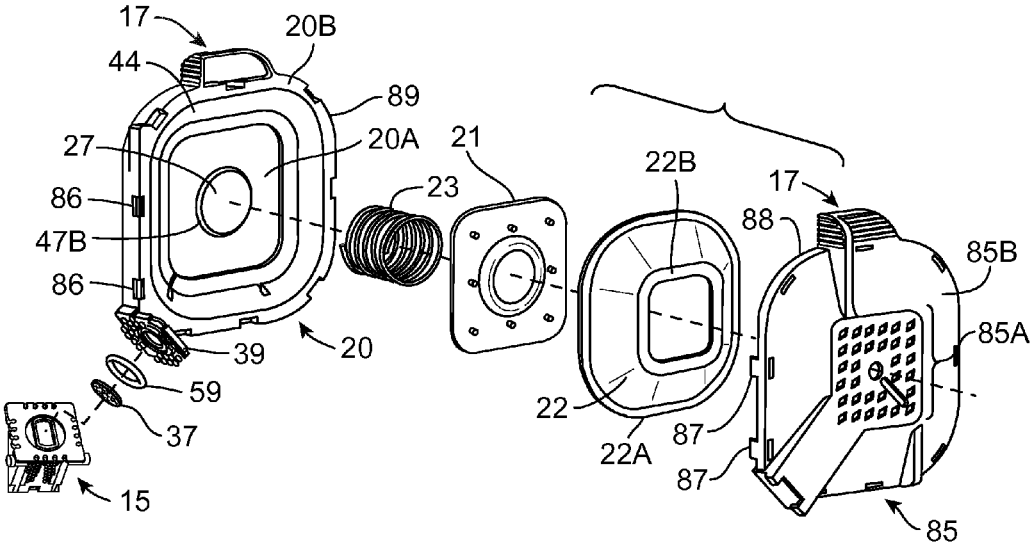
FIG. 3 is an exploded view of the inkjet cartridge shown in FIG. 1.

An inkjet cartridge 10 shown in FIGS. 1, 2A, and 3 may be mounted on a moveable or stationary carrier for printing and has a printhead 16 in fluid communication with an ink reservoir 19 within cartridge 10. Responsive to printing commands from a controller (not shown), the printhead 16 discharges ink from the ink reservoir 19 onto a print medium (not shown). The cartridge may be similar to that disclosed in U.S. Pat. No. 8,272,704 and assigned to Videojet Technologies Inc., the contents of which are hereby incorporated by reference. The cartridge 10 includes cover 85, basin member 20, and moveable plate 21 (shown in later Figures). The barrier layers are not shown in FIGS. 1-3.

A rigid cover 85 is mounted to the basin member 20 so that the cover 85 with the basin 20 forms a rigid durable housing or casing having an interior in which the ink reservoir 19 is disposed and protected. As shown, the basin member 20 includes a plurality of notches 86, disposed along an outer peripheral edge 88 of the basin member 20. Tabs 87 descend from an outer peripheral edge 89 of the cover 85 and fit in mating relationship with the notches 86 to snap and secure the cover 85 to the basin 20. The basin 20, flexible membrane 22 and the rigid moveable plate 21 are positioned and secured relative to one another to form the ink reservoir 19. A handle 17 including transversely oriented gripping portions 126, 127 may be disposed on the cartridge 10. The cartridge 10 may include a fill hole 34 for providing an ink composition into the reservoir 19 during the manufacturing process. Ribs 12 may extend inward from the outer periphery of the cartridge 10, to provide structural support for the basin member 20.

A second embodiment of a cartridge 11 is shown in FIG. 2B. The key differences from cartridge 10 are that cartridge 11 has shorter ribs 13 to allow for easier application of the barrier layer. Additionally, embodiment 11 does not include a fluid fill hole. The use of a fill hole may increase the amount of solvent lost from the cartridge through migration or leakage. Instead, the ink reservoir is filled with through channel 35 and standpipe 38 (described below). Embodiment 11 may include an orientation hole 48. The orientation hole 48 does not connect into the ink reservoir, but is rather used for positioning the cartridge during the filling process.

Figure 9:
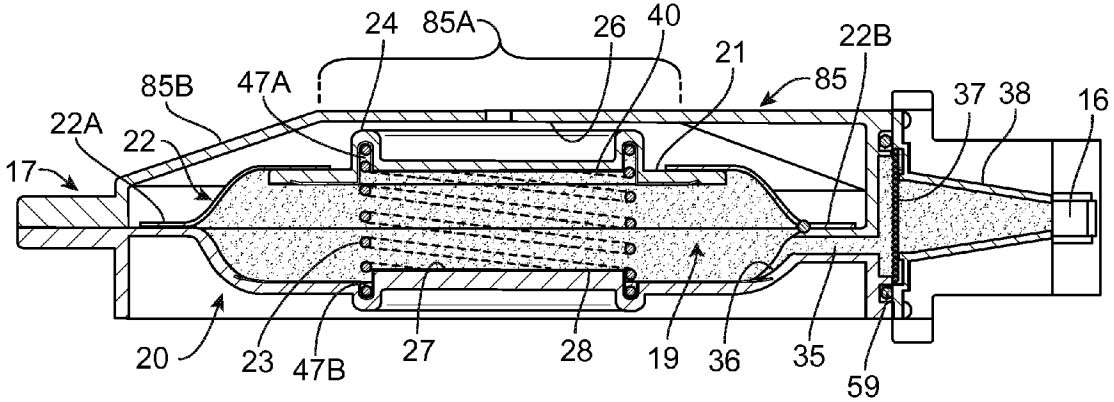
FIG. 9 is a sectional view of the inkjet cartridge shown in FIG. 1 with the ink reservoir expanded and filled with ink.
Figure 10:
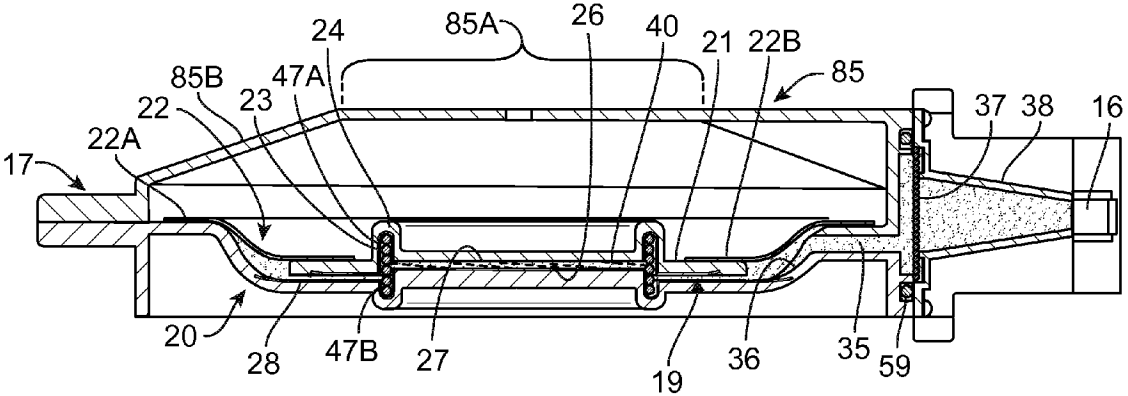
FIG. 10 is a sectional view of the inkjet cartridge shown in FIG. 1 with the ink reservoir having collapsed.

In reference to the ink reservoir 19 shown in FIGS. 9 and 10, a spring 23 is disposed within the ink reservoir 19 between the basin member 20 and the plate 21, and biases the plate 21 away from the basin member 20 to generate a negative or back pressure in the ink reservoir 19 to prevent ink from drooling from the nozzles on the printhead 16. As ink is ejected during printing and other operations, the flexible membrane 22 collapses towards the basin member 20 causing the plate 21 to move towards the basin member 20. The spring 23 biasing force against the plate 21 generates the negative pressure in the ink reservoir 19.

The spring 23 may be seated against the plate 21 and basin member 20. Flexible membrane 22 and plate 21 collapse a sufficient dimension to allow as much ink as possible to be emptied from the reservoir 19. The grooves 47A and 47B are generally annular grooves for embodiments incorporating a helical spring. The grooves 47A and 47B may be aligned with one another so when the flexible membrane 23 and plate 21 collapse, the grooves 47A and 47B have a combined depth dimension to receive the spring 23.

In reference to FIGS. 9 and 10, the cover 85 includes a middle section 85A that is laterally displaced relative to the outer peripheral edge 89 of the cover 85 and away from the basin member 20 so that sides 85B of the cover 85 are angled obliquely relative to the midsection 85 and peripheral edge 89. In this manner, as shown in FIG. 9, at least a portion of the ink reservoir 19 including a portion of the moveable plate 21, flexible membrane 22 and/or spring 23 are surrounded by the cover 85, or the cover 85 receives a portion of the ink reservoir when the reservoir 19 is filled with ink and in an expanded state.

In addition, the bowl-like configuration of the basin member 20 that includes a rim 20B and the wall 44 sloping to the floor 20A allows the flexible membrane 22 to collapse along a surface of the basin member 20. In addition, a recess 26 in the plate 21 receives a raised portion 27 on the basin member 20 so the moveable plate 21 may be generally flush against the basin 20 to empty as much ink as possible from the reservoir 19. Moreover, as the flexible membrane 22 collapses it may follow the contour of the wall 44 and is generally flush with the surface of the basin member 20.

The cartridge 10 includes at least one barrier layer for reducing the migration of organic solvent. By migration is meant loss of solvent from the cartridge through diffusion, evaporation, and similar processes, as opposed to loss of ink by printing. The basin member 20 defines a first major portion of the ink reservoir 19 and the movable plate 21 defines a second major portion of the ink reservoir 19. At least one of the basin member 20 and the movable plate 21 includes a barrier layer for reducing the migration of solvent from the ink reservoir 19 to an external environment. In an embodiment, a barrier layer is disposed on both the basin member 20 and the movable plate 21. The barrier layer is made of a material with a greater resistance to solvent migration than the other materials of the basin member 20, plate 21, and other materials of the cartridge 10. In particular, the other components are typically composed of a plastic such as high density polyethylene (HDPE); the barrier layer is made of a material that provides greater resistance to solvent migration than HDPE. Thus, the barrier layer reduces the rate of solvent loss compared to a cartridge without a barrier layer. The barrier layer is preferably disposed over or upon a generally rigid substrate, such as surfaces of the basin member 20 and plate 21.

Figure 4:
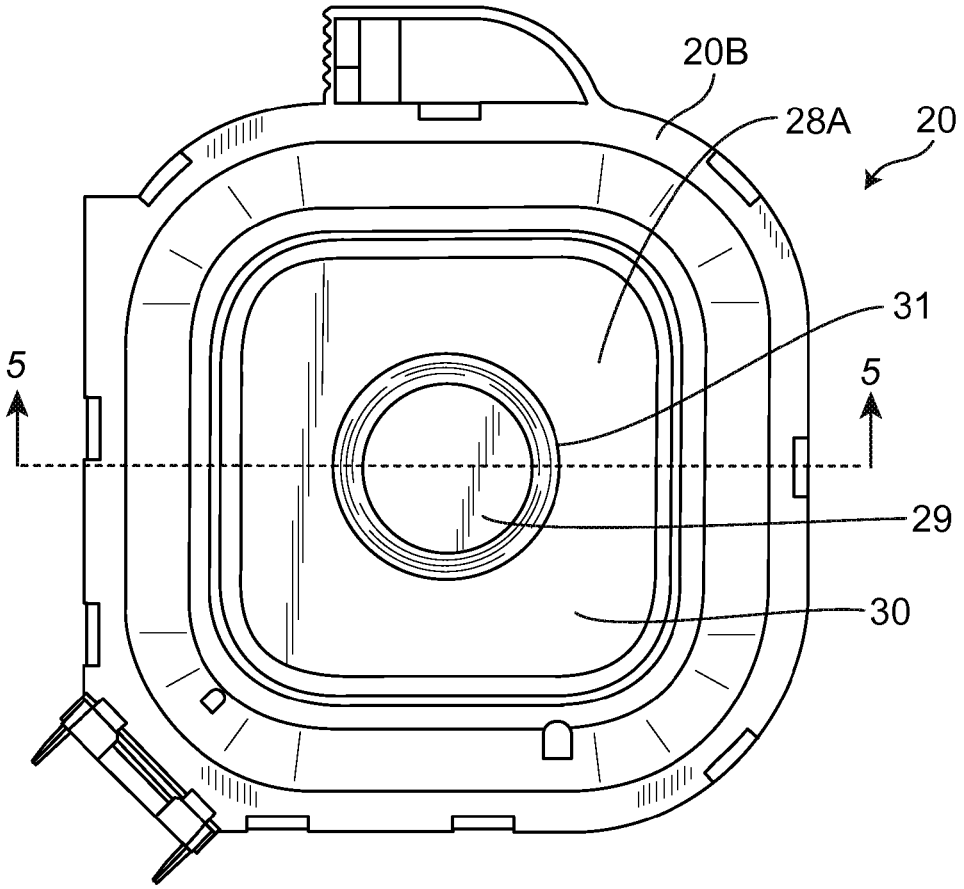
FIG. 4 is a perspective view of an embodiment of a basin member with a barrier layer.
Figure 5:
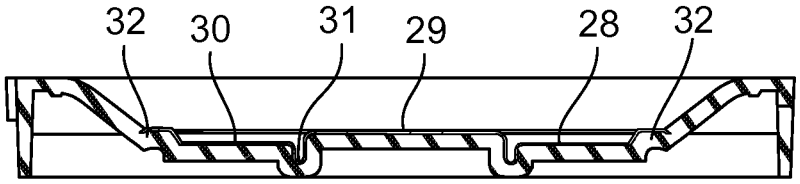
FIG. 5 is a sectional view along line 5-5 of FIG. 4.

A basin member 20 with one embodiment of a barrier layer 28 is shown in FIGS. 4 and 5. In general, barrier layers are disposed along major portions, but not the entirety, of the area of the ink reservoir 19. The barrier layer 28 closely follows the shape of the basin member 20 and is secured to the surface thereof. The barrier layer 28 includes circular raised center portion 29, circular groove 31 surrounding center 29, and a flat portion 30 surrounding groove 31. The periphery 32 of the barrier layer 28 may be disposed into the plastic material of basin member 20 (such as by molding the material of basin member 28 around the barrier layer 28 during the molding process) to secure it thereto. The structure of barrier layer 28 corresponds to that of basin member 20; in particular, raised portion 29 corresponds to and is disposed adjacent to raised portion 27, circular groove 31 corresponds to and is disposed adjacent to groove 47B, and flat portion 30 corresponds to and is disposed adjacent to floor 20A.

Figure 6:
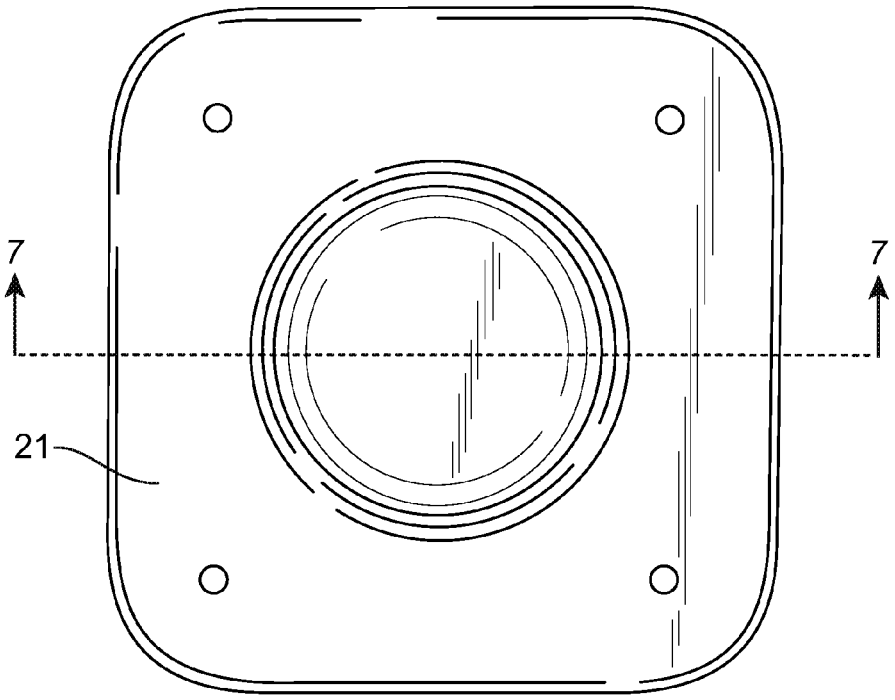
FIG. 6 is a perspective view of an embodiment of a moveable plate with a barrier layer.
Figure 7:
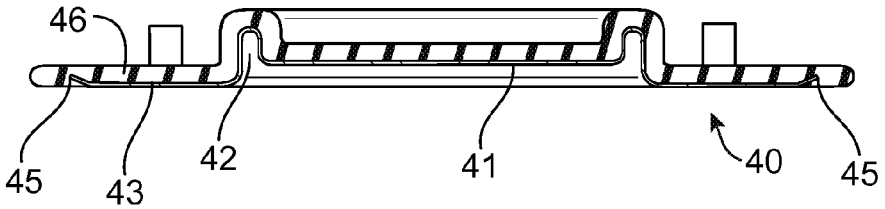
FIG. 7 is a sectional view along line 7-7 of FIG. 6.
Figure 8:
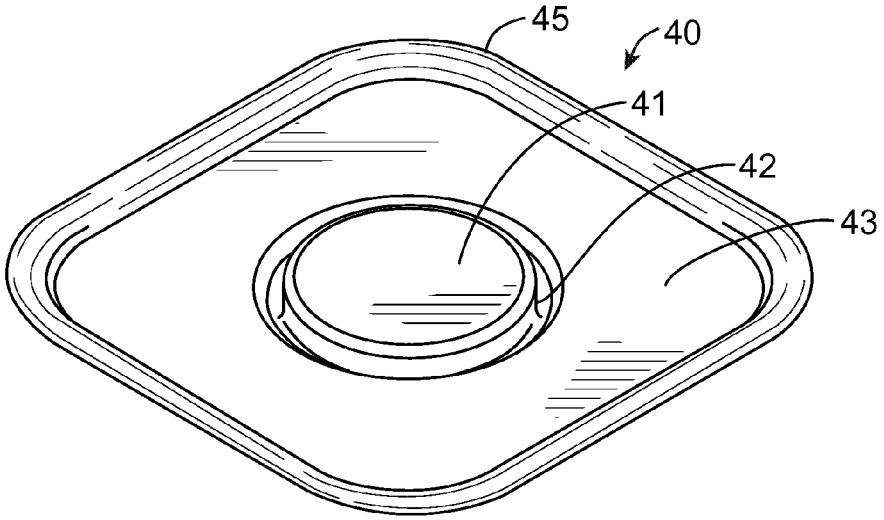
FIG. 8 is a perspective view of the barrier layer of FIGS. 6 and 7.

A plate 21 with one embodiment of a barrier layer 40 is shown in FIGS. 6-8. Similar to barrier layer 28, the barrier layer 40 for the moveable plate 21 closely follows the shape of the moveable plate 21 and is secured to the surface thereof. The barrier layer 40 includes circular raised center portion 41, circular groove 42 surrounding center 41, and flat portion 43 surrounding groove 42. The periphery 45 of the barrier layer 40 is disposed into the plastic material of moveable plate 21 (such as during the molding process) to secure it thereto. The structure of barrier layer 40 corresponds to that of plate 21; in particular, raised portion 41 corresponds to and is disposed adjacent to recess 26, circular groove 42 corresponds to and is disposed adjacent to groove 47A, and flat portion 43 corresponds to and is disposed adjacent to the flat surface 46. Thus, in an embodiment, the surface of barrier layers 28 and 40 directly contact the ink in the ink reservoir 19. As best seen in FIG. 9, the barrier layers 28 and 40 may be disposed on rigid generally flat surfaces or planes disposed parallel to each other.

The barrier layers 28 and 40 may be secured to the adjacent components by any suitable method. In one embodiment, the basin member 20 is injected molded around the barrier layer 28. In particularly, the components are fashioned so that the periphery 32 of the barrier layer 28 is embedded into the basin member 20. Similarly, the movable plate 21 may be injected molded around the barrier layer 40, with the periphery 45 of the barrier layer 40 is embedded into the plate 21. In an embodiment, the barrier layers 28 and 40 are composed of steel. The barrier layers 28 and 40 may be between 0.1 mm and 0.5 mm thick, preferably between 0.2 and 0.3 mm.

The basin member 20 and the plate 21 may be composed of a high density polyethylene material or other suitable plastic material. The plastic material may also include a filler to further prevent solvents loss. The filler may be a polymeric oxygen or gas barrier material.

The barrier layers preferably cover a sufficient surface area of the ink reservoir in order to prevent loss of volatile solvent, but do not need to cover the entire surface area. In one embodiment, the barrier layer covers at least 50%, 60%, or 75% of the ink-facing surface area of the ink reservoir 19. The barrier layer may cover less than 75%, 85%, or 90% of the surface area of the ink reservoir 19. In general, the barrier layer may cover between 60% to 90% of the surface area of the ink reservoir 19.

In a preferred embodiment, the basin member 20 remains stationary while the flexible membrane 22 and plate 21 move relative to the basin 20. Accordingly, this embodiment includes a single membrane 22 and single plate 21 that move relative to the stationary basin 20. The flexible membrane 22 may have the annular configuration shown in FIG. 3, having a first peripheral edge 22A sealed against the basin member 20 and a second peripheral edge 22B sealed against the moveable plate 21. As shown in FIGS. 9 and 10, the edge 22A of the flexible membrane 22 is spaced inwardly relative to the outer peripheral edge 89 of the basin member 20. In addition, the flexible membrane 22 of the subject invention is affixed to the plate 21 along a periphery of the plate 21 or about a central area of the plate 21 and defines a portion of the periphery thereof. As illustrated, the plate 21 has an annular protrusion 24 forming a groove or recess 47A for receiving a first end of the spring 23. The annular protrusion 24 is centrally located on the plate 21; therefore the flexible membrane 22 is not bonded to the center of the plate 21, but may be secured by suitable means such as welding to one or more points about the protrusion 24 along a periphery of the plate 21.

Figure 11:
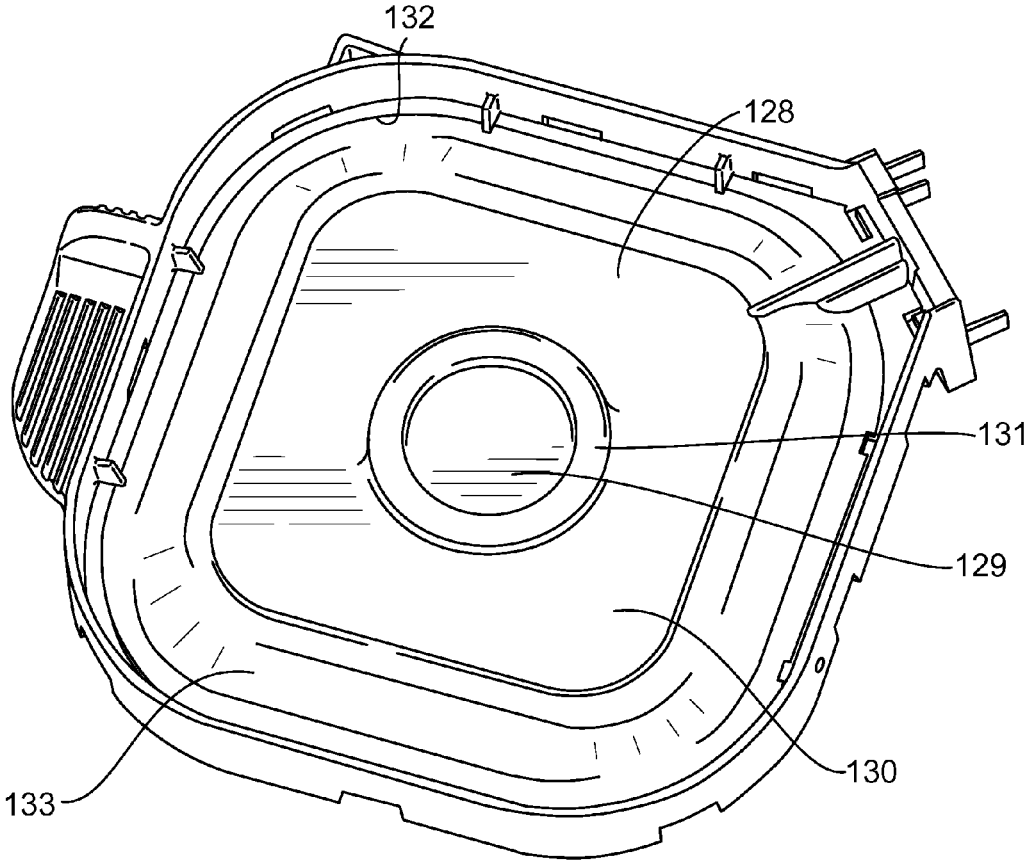
FIG. 11 is a perspective view of a second embodiment of a barrier layer.

A second embodiment of a barrier layer 128 for the basin member 20 is shown in FIG. 11. Barrier layer 128 is formed of a composite material with a metal foil layer Like barrier layer 28, barrier layer 128 closely follows the shape of the basin member 20 and is secured to the surface thereof. The barrier layer 128 includes circular raised portion 129, circular groove 131, and a flat portion 130. Portion 133 extends between flat portion 130 and periphery 132. The periphery 132 of the barrier layer 128 is disposed into the plastic material of basin member 20 (such as during the molding process) to secure it thereto. Raised portion 129 corresponds to and is disposed adjacent to raised portion 27, circular groove 131 corresponds to and is disposed adjacent to groove 47B, flat portion 130 corresponds to and is disposed adjacent to floor 28, and portion 133 corresponds to and is disposed adjacent to sloping wall 44. A separate barrier layer of similar construction (not shown) may be applied to the plate 21.

The barrier layer 128 is a composite layer including a metal foil layer. The composite layer may include a metal foil layer surrounded by one or more polymer layers. In an embodiment, the composite layer includes a metal layer surrounded by polymer layers, such as an oriented polypropylene (OPP) layer as a first outer layer, a white laminant layer, a metal foil layer, an ethylene acrylic acid copolymer layer, and a linear low density polyethylene (LLDPE) layer as the second outer layer. Other types of polymer layers are possible; alternatively, the barrier layer may just include the metal foil layer. The total thickness of the composite layer may be between 0.05 mm and 0.2 mm thick. The thickness of the metal foil layer itself may be between 0.002 mm and 0.02 mm.

The cartridge is designed to use a solvent-based ink. Thus, in one embodiment, an ink composition is disposed within the ink reservoir. The ink composition includes an organic solvent. In one embodiment, the organic solvent is selected from ketones and alcohols. The organic solvent may have a vapor pressure at a temperature of 20° C. of at least 16 mm Hg, 43 mm Hg, or 74 mm Hg. Alternatively, the organic solvent may have a relative evaporation rate (relative to n-butylacetate) of at least 1.4, at least 2.1 or at least 3.8. The organic solvent may be present in an amount at least 70% by weight of the ink composition. Suitable inks are disclosed in U.S. Pat. No. 8,142,559, assigned to Videojet Technologies Inc., the contents of which are hereby incorporated by reference. The materials of the barrier layer should be compatible with the organic solvent disposed in the ink reservoir.

The barrier layers have been found to greatly decrease the amount of organic solvent lost form the cartridge due to solvent migration. In particular, solvent migration from the ink reservoir to an exterior of the cartridge is at least 30%, 40%, or 50% less than a solvent migration from the ink reservoir to an exterior of the cartridge of an identical cartridge without the barrier layer, at a temperature of 52° C. over a period of two weeks. In other words, the barrier layer decreases solvent migration from the ink reservoir to an exterior of the cartridge by at least 30%, 40%, or 50% compared to solvent migration from the ink reservoir to an exterior of the cartridge of an identical cartridge without the barrier layer. The ink cartridge with the barrier layer preferably loses less than 5% by weight of the ink, preferably less than 3%, at a temperature of 52° C. over a period of two weeks.

In an embodiment, the cover 85 may be composed of durable plastic material such as polyethylene or other plastic materials of suitable durability to serve as a protective casing for the ink reservoir 19. The basin member 20 and plate 21 are composed of the same rigid plastic material such as polyethylene, and the flexible membrane is composed of a different plastic material that is pliable enough to allow the plate 21 to move relative to the stationary basin member 20, durable enough to prevent tearing and compatible with the plastic material of the basin member 20 and plate 21 so the flexible membrane 22 may be adequately sealed to the basin member 20 and plate 21. The flexible membrane 22 may comprise a laminate structure that includes a polyethylene carrier layer, a polypropylene sealant layer and a metallized plastic layer.

Also with respect to FIGS. 9 and 10, there is formed in the wall 44 of the basin member 20 a chute 36 that extends between the floor 20A of the basin 20 and the channel 35. The chute 36 allows for ink from the reservoir 19 to continue to be supplied to the printhead 16 when the plate 21 and flexible membrane 22 are collapsing. As illustrated in FIG. 10, when the flexible membrane 22 is collapsing into the basin 20, the membrane 22 may block the opening to the channel 35; however, ink may still travel to the channel 35 and to the printhead 16 via the chute 36. In this manner, a maximum volume of ink can be withdrawn from the reservoir 19 minimizing the wasting of ink, especially if the cartridge is disposable.

A more detailed description of the basin member 20, snout 15 and their components is provided. In reference to FIGS. 9 and 10, the snout 15 is secured directly to the basin member 20 and includes the printhead 16 mounted thereon and nozzles (not shown) in fluid communication with the ink reservoir 19 to eject ink from the cartridge per printing commands. The printhead 16 is mounted to a first surface 15A of the snout 15, and an electrical interconnect is mounted to a second surface 15B to place the printhead 16 in electrical communication with a printing system controller. The snout 15 is fabricated as a component independent of the basin member 20 and cover 85, and may be composed of any durable plastic and dimensionally stable plastic material such as a glass-filled polyphenylene sulfide resin.

With respect to FIGS. 9 and 10, a channel 35 is formed in the basin member 20 and leads to the snout 15. A support member 39 is integrally formed with the basin member 20 and supports the snout 15 on the basin member 20. The channel 35 extends through the basin member 20 and past the support member 39 providing fluid communication between the ink reservoir 19 and the snout 15. A standpipe 38 disposed in the snout 15 between the channel 35 and printhead 16, connects the printhead 16 and nozzles (not shown) in fluid communication with the ink reservoir 19.

As shown FIGS. 9 and 10 an o-ring 59 is disposed between the support member 39 and snout 15 to seal the interface between the two components and prevents ink passing from the ink reservoir 19 to the snout 15 from leaking from the cartridge 10. A screen 37 may filter debris from the ink passing to the printhead 16 on the snout 15; and, may prevent gas bubbles from passing from the standpipe 38 to the ink reservoir 19.

EXAMPLES

Four embodiments of cartridges were prepared and filled with an organic solvent based ink. The ink was approximately 85% methyl ethyl ketone as the organic solvent. The cartridges were stored in controlled temperature environments for a period of time. The cartridges were weighed at the beginning and then at regular intervals to determine the amount of solvent that had migrated from the ink reservoir out of the cartridge. An accelerated storage test was set up to store the cartridges at 52° C. for two weeks, and then change the storage temperature to 35° C. The weight of each cartridge was determined at 2 weeks, around 3 months, and around 6 months. The weight loss was determined by measuring the change in cartridge weight at each time point (2 weeks, 3 months and 6 months) from the original cartridge weight.

Comparative Example A was a cartridge with no barrier layers (as shown in FIGS. 1-3). Example 1 included a steel insert on the basin member and plate (as shown in FIGS. 4-8). The steel insert was about 0.254 inches thick and made of type 305 stainless steel. Example 2 included composite metal foil layers on the basin member and plate (as shown in FIG. 11). The composite layer was a commercially available product including a metal layer surrounded by polymer layers of oriented polypropylene (OPP) layer as a first outer layer, a white laminant layer, a metal foil layer 0.007 mm thick, an ethylene acrylic acid copolymer layer, and a linear low density polyethylene (LLDPE) layer as the second outer layer. Example 3 included a steel insert on the basin member and plate (as shown in FIGS. 4-8); additionally, the components were molded from HDPE with a vapor barrier enhancing filler.

Table 1 below shows the solvent loss from each Example. It can be seen that the Example 1 reduced solvent loss by almost 50% compared to Comparative Example A after the first 14 days. Example 2 reduced solvent loss by over 60% compared to Comparative Example A after the first 14 days. Example 3 reduced solvent loss by over 50% compared to Comparative Example A after the first 14 days. Thus, it can be seen that various embodiments of the disclosed barrier layers reduced solvent loss by over 40%, compared to the same cartridge design without the barrier layers, and reduced solvent loss to less than 5% by weight of the ink.

TABLE 1

| Design | Solvent loss after 14 days @ 52° C. | Solvent loss after 14 days @ 52° C. followed by 77 days @ 35° C. | Solvent loss after 14 days @ 52° C. followed by 168 days @35° C. |
|---|---|---|---|
| Comparative Example A | 6.1% | 14.3% | 21.2% |
| Example 1 (steel insert) | 3.1% | 7.8% | 13.8% |

TABLE 1-continued

| Design | Solvent loss after 14 days @ 52° C. | Solvent loss after 14 days @ 52° C. followed by 77 days @ 35° C. | Solvent loss after 14 days @ 52° C. followed by 168 days @35° C. |
|---|---|---|---|
| Example 2 (foil) | 2.4% | 5.9% | n/a |
| Example 3 (steel inserts and polymer filler) | 2.7% | 7.7% | n/a |

While the preferred embodiments of the present invention have been shown and described herein, it will be obvious that such embodiments are provided by way of example only and not of limitation. Numerous variations, changes and substitutions will occur to those skilled in the art without departing from the teaching of the present invention. Accordingly, it is intended that the invention be interpreted within the full spirit and scope of the appended claims.

What is claimed is:

1. A thermal inkjet cartridge for an organic solvent-based ink comprising: a cartridge housing; a printhead attached to the housing; a collapsible ink reservoir disposed in the housing, the ink reservoir having an opening through which ink is supplied to the printhead in fluid communication with the ink reservoir, the reservoir comprising: a basin member defining a first major portion of the ink reservoir; and a movable plate defining a second major portion of the ink reservoir; wherein at least one of the basin member and the movable plate comprises a barrier layer for reducing the migration of solvent from the ink reservoir to an external environment; wherein the barrier layer decreases solvent migration from the ink reservoir to an exterior of the cartridge by at least 30% compared to solvent migration from the ink reservoir to an exterior of the cartridge of an identical cartridge without the barrier layer over a period of two weeks at 52° C.

2. The thermal inkjet cartridge of claim 1 wherein the barrier layer is disposed on both the basin member and the movable plate.

3. The thermal inkjet cartridge of claim 1 wherein the barrier layer comprises a metal layer.

4. The thermal inkjet cartridge of claim 3 wherein the metal layer comprises steel.

5. The thermal inkjet cartridge of claim 3 wherein the metal layer is between 0.1 mm and 0.5 mm thick.

6. The thermal inkjet cartridge of claim 1 wherein the barrier layer comprises a composite layer comprising a metal foil layer surrounded by one or more polymer layers.

7. The thermal inkjet cartridge of claim 6 wherein the foil layer is between 0.002 mm and 0.02 mm thick.

8. The thermal inkjet cartridge of claim 1 wherein the cartridge does not include a separate fill hole apart from the opening.

9. The thermal inkjet cartridge of claim 1 wherein a portion of the basin member is molded around a periphery of the barrier layer.

10. The thermal inkjet cartridge of claim 1 wherein a portion of the movable plate is molded around a periphery of the barrier layer.

11. The thermal inkjet cartridge of claim 1 wherein at least one of the basin member and the movable plate comprises a vapor barrier material.

12. The thermal inkjet cartridge of claim 1 wherein the basin member comprises a high density polyethylene material.

13. The thermal inkjet cartridge of claim 1 wherein the ink reservoir has an ink-facing surface area and the barrier layer covers at least 60% of the surface area.

14. The thermal inkjet cartridge of claim 1 wherein the barrier layer comprises a generally flat surface with an annular projection extending from the flat surface.

15. The thermal inkjet cartridge of claim 1, further comprising an ink composition disposed within the ink reservoir, wherein the ink composition comprises an organic solvent.

16. The thermal inkjet cartridge of claim 15 wherein the organic solvent is selected from ketones and alcohols.

17. The thermal inkjet cartridge of claim 15 wherein the organic solvent has a vapor pressure at a temperature of 20° C. of at least 16 mm Hg.

18. The cartridge of claim 15 wherein the solvent is present in an amount at least 70% by weight of the ink composition.

19. The cartridge of claim 15 wherein the one or more barrier layers are in contact with the ink composition.

* * * * *